US007261922B2

(12) United States Patent
Kempkes

(10) Patent No.: US 7,261,922 B2
(45) Date of Patent: Aug. 28, 2007

(54) METHOD OF APPLYING ADDITIONAL CORROSION PROTECTION TO A LOCALIZED PORTION OF A GALVANIZED POLE

(75) Inventor: Carleton D. Kempkes, Omaha, NE (US)

(73) Assignee: Valmont Industries, Inc., Valley, NE (US)

( * ) Notice: Subject to any disclaimer, the term of this patent is extended or adjusted under 35 U.S.C. 154(b) by 157 days.

(21) Appl. No.: 10/898,443

(22) Filed: Jul. 23, 2004

(65) Prior Publication Data

US 2006/0019038 A1 Jan. 26, 2006

(51) Int. Cl.
*B05D 3/12* (2006.01)
*B05D 5/00* (2006.01)
*B05D 1/18* (2006.01)

(52) U.S. Cl. ..... 427/290; 427/433; 427/289; 427/256; 427/310

(58) Field of Classification Search ..... None
See application file for complete search history.

(56) References Cited

U.S. PATENT DOCUMENTS 3,927,816 A * 12/1975 Nakamura ..... 228/147
5,035,042 A * 7/1991 Maitra et al. ..... 29/527.4
5,666,714 A * 9/1997 Height et al. ..... 29/527.4
6,280,795 B1 * 8/2001 Zervoudis et al. ..... 427/433

FOREIGN PATENT DOCUMENTS

EP 490189 A1 * 6/1992
JP 01047842 A * 2/1989

* cited by examiner

*Primary Examiner*—William Phillip Fletcher, III
*Assistant Examiner*—Cachet I. Sellman
(74) *Attorney, Agent, or Firm*—Thomte, Mazour & Niebergall, LLC; Dennis L. Thomte

(57) ABSTRACT

The invention relates to a method of providing additional corrosion protection to a localized portion of a pole such as a utility pole, support pole, or the like comprising the steps of: (1) determining which portion of the pole is to receive additional corrosion protection; (2) blast cleaning that localized portion of the pole which is to receive additional corrosion protection; (3) placing the pole into a caustic tank; (4) removing the pole from the caustic tank; (5) subjecting the pole to a caustic rinse; (6) placing the pole into an acid tank; (7) removing the pole from the acid tank; (8) subjecting the pole to an acid rinse; (9) placing the pole into a flux tank; (10) removing the pole from the flux tank; (11) placing the pole into a heated galvanizing kettle; and (12) removing the pole from the galvanizing kettle.

15 Claims, No Drawings

METHOD OF APPLYING ADDITIONAL CORROSION PROTECTION TO A LOCALIZED PORTION OF A GALVANIZED POLE

BACKGROUND OF THE INVENTION

1. Field of the Invention

This invention relates to a galvanized steel support pole, such as a utility pole or the like, which has additional localized corrosion protection thereon. This invention also relates to the method of providing additional corrosion protection to a localized portion of the support pole.

2. Description of the Related Art

Galvanized steel poles are sometimes placed into service wherein the lower ends of the poles are subjected to corrosive soil and/or water. The customary galvanic coating, usually comprised of zinc or zinc-rich alloy, will resist the corrosive environment for some time, but will possibly deteriorate over a period of time.

SUMMARY OF THE INVENTION

A galvanized steel support pole, such as a utility pole or the like, is provided which has an increased thickness of a galvanic coating (zinc) applied thereto in a localized area of the pole, usually at the lower end thereof. The method of providing additional corrosion protection for a pole comprises the steps of: (1) determining which portion of the pole is to receive additional corrosion protection during the subsequent galvanizing of the pole; (2) blast cleaning that portion of the pole which is to receive additional corrosion protection to create a profiled surface thereon; (3) placing the pole into a caustic tank for a predetermined length of time; (4) removing the pole from the caustic tank; (5) subjecting the pole to a caustic rinse; (6) placing the pole into an acid tank for a predetermined length of time; (7) removing the pole from the acid tank; (8) subjecting the pole to an acid rinse; (9) placing the pole into a flux tank for a predetermined length of time; (10) removing the pole from the flux tank; (11) placing the pole into a heated galvanizing kettle for a predetermined length of time; and (12) removing the pole from the galvanizing kettle.

In the preferred embodiment, the localized area of the pole is blast cleaned in a blasting booth to create a profiled surface thereon which is at least 3.5 mil. Additionally, in the preferred embodiment, the pole is placed in a drying oven for a predetermined length of time after the pole is removed from the flux tank. That portion of the pole which was blast cleaned and profiled has a galvanic (zinc) coating which averages 6.0 mil. and the remaining area of the pole meets ASTM-123.

It is therefore a principal object of the invention to provide a support pole such as a utility pole or the like which has additional corrosion protection on a localized area thereof.

A further object of the invention is to provide a method of providing additional corrosion protection for a localized portion of a support pole such as a utility pole or the like.

Still another object of the invention is to provide a method of providing additional corrosion protection for a localized area of a support pole wherein the localized area of the support pole is blast cleaned to create a profiled surface thereon thereby increasing the surface area thereof and increasing the activity of the surface for intermetallic formation of the galvanic coating such as zinc thereon with the profiled surface enabling the application of a galvanic coating thereon which has an increased thickness as compared to the remainder of the pole.

These and other objects will be apparent to those skilled in the art.

DETAILED DESCRIPTION OF THE INVENTION

Galvanized poles or support poles are frequently used as utility poles, light poles, etc. The poles normally are galvanized with a zinc or zinc-rich alloy to prevent the pole from rusting. However, the support poles are sometimes subjected to corrosive soil conditions or corrosive water conditions which causes the galvanic coating thereon to deteriorate over a period of time. The object of this invention is to provide additional localized corrosion protection on the support pole. The support pole is first measured for the dimensions to blast clean. Normally, it will be the lower end of the support pole which will be blast cleaned. A suitable marker such as a magic marker is used to mark the localized area of the pole to be blasted. The pole is then moved to a blasting booth to blast clean the area which is to receive additional corrosion protection. In the blasting booth, the surface to receive the additional corrosion protection is profiled to a 3.5 mil. minimum. The profiling of the localized area of the pole increases the surface area thereof and also increases the diffusion rate of the surface for intermetallic formation of the galvanic coating such as zinc so that the profiled surface will have an increased galvanic coating as compared to the remainder of the pole. The pole is then transferred to a galvanizing area for the galvanizing process to take place. During the galvanizing operation, the pole is placed into a conventional caustic tank with the pole remaining in the caustic tank preferably for a minimum of ten minutes. The pole is removed from the caustic tank and allowed to drain until the drainage becomes an interrupted drip. The pole is then moved to the caustic rinse tank.

The pole is passed through a caustic rinse and removed therefrom. The pole is allowed to drain until the drainage becomes an interrupted drip. The pole is then moved to the next available acid tank.

The pole is then placed in the acid tank and the pole remains in the acid tank preferably for a minimum of ten minutes. The pole is removed from the acid tank and allowed to drain until the drainage becomes an interrupted drip. The pole is then moved to the acid rinse tank.

The pole is passed through the acid rinse tank and then removed therefrom and allowed to drain until the drainage comes an interrupted drip. The pole is then placed into a flux tank and preferably remains in the flux tank for approximately two minutes. The pole is removed from the flux tank and allowed to drain until the drainage becomes an interrupted drip. The pole is allowed to dry and then moved to a galvanizing kettle. If a drying oven (pre-heater) is available, the pole is placed in the drying oven for a minimum of approximately twenty minutes. If a drying oven is not available, the pole which has been removed from the flux tank will be applied directly to the galvanizing kettle. The pole is submerged in the galvanizing kettle and remains fully submerged in the kettle for approximately eight to ten minutes. After the pole reaches kettle temperature, the skimming of the surface oxide is directed to the designated end of the galvanizing kettle.

The pole is slowly removed from the galvanizing kettle and moved to a finishing area. At this time, the pole is cleaned and checked to assure approximately 6.0 mils.

thickness of the galvanic coating (zinc) in the designated area and must meet ASTM-123 in the other areas of the pole. Although the process described above is described as handling a single pole, normal practice will be to handle several poles at the same time. Hereinbelow is a more detailed description of the method of this invention. Additionally, certain follow-up measurement and inspection steps are also described.

1.0 Blast Cleaning Operation 1.1 Poles are measured for the dimensions to blast clean. These dimensions are calculated by the prints matching the pole. Prints for blast clean poles are provided by the customer. A magic marker is used to mark the area of the pole to be blasted.

1.2 Poles are then moved to the blasting booth to blast clean the dimensions provided by the customer. The surface shall be profiled to a 3.5 mil minimum. Every third pole will be checked using Press-O-Film (x course) profile tape.

1.3 Poles are then transported to the Galvanizing Department for the Galvanizing Process to take place.

2.0 Galvanizing Operation 2.1 Poles are placed into the caustic tank. All poles must remain in the caustic tank for a minimum of 10 minutes. Remove the poles from the caustic and allow them to drain until the drainage becomes an interrupted drip. Move the poles to the caustic rinse tank.

2.2 Pass the poles through the caustic rinse. Remove the poles from the caustic rinse and allow them to drain until the drainage becomes an interrupted drip. Move the poles to the next available acid tank.

2.3 Poles are then placed in the acid tank. All poles must remain in the acid for a minimum of 10 minutes. Remove the poles from the acid tank and allow them to drain until the drainage becomes an interrupted drip. Move the poles to the acid rinse tank.

2.4 Pass the poles through the acid rinse tank. Remove the poles from the acid rinse and allow them to drain until the drainage becomes an interrupted drip.

2.5 Poles are then placed into the flux tank. All poles must remain in the flux for 2 minutes. Remove the poles from the flux and allow them to drain until the drainage becomes an interrupted drip. Allow the poles to dry and move to the kettle.

2.6 If a drying oven (pre-heater) is available, place the poles in the drying oven for a minimum of 20 minutes. If no drying oven is available, go directly to the next step.

2.7 Submerge the poles into the kettle. The poles must remain fully submerged in the kettle for 8 to 10 minutes. After the poles reach kettle temperature, direct the skimming of the surface oxide to the designated end of the galvanizing kettle.

2.8 Slowly remove the poles from the kettle.

2.9 Move the poles to the finishing area. At this time, the poles are cleaned and checked to assure 6.0 mils in the designated zincplus area and must meet ASTM-123 in the non-zincplus area.

3.0 Measurement and Inspection 3.1 The production supervisor inspects the poles for any flaws or defects.

3.2 The production supervisor inspects the thickness of the coating to assure a 6.0 mil reading.

3.3 Once the supervisor completes the inspection of the clean-up of the pole and the mil thickness, the pole is ready for quality control inspection.

3.4 The quality control inspector checks the poles for any flaws or defects.

3.5 The quality control inspector checks the thickness of the coating to assure an average 6.0 mil reading in the designated zincplus area to assure the thickness of the coating meets ASTM-123 in the non-zincplus area. A minimum of six measurements must be taken in the zincplus area. Follow ASTM-123 for the number of measurements in the non-zincplus area.

3.6 The quality control inspector completes the thickness reading report for each pole.

3.7 The thickness reading report for each pole is filed with the completed customer order.

Thus it can be seen that a novel method has been described which assures that additional galvanic coating (zinc) will be applied to a localized area on the pole so that the localized area of the pole may resist the corrosive effects of soil and/or water.

Thus it can be seen that the invention accomplishes at least all of its stated objectives.

I claim:

1. The method of providing additional corrosion protection for a portion of a pole by increasing the thickness of a galvanizing layer comprising the steps of:

determining which portion of the pole is to receive additional corrosion protection during the subsequent galvanizing of the pole with the said portion of the pole being less than the entire pole;

cleaning the said portion of the pole to create a profiled surface thereon thereby increasing the surface area of the said portion;

placing the pole into a caustic tank for a predetermined length of time;

removing the pole from the caustic tank;

subjecting the pole to a caustic rinse;

placing the pole into an acid tank for a predetermined length of time;

removing the pole from the acid tank;

subjecting the pole to an acid rinse;

placing the pole into a flux tank for a predetermined length of time;

removing the pole from the flux tank;

placing the pole into a heated galvanizing kettle for a predetermined length of time; and removing the pole from the galvanizing kettle.

2. The method of claim 1 wherein the said portion of the pole is cleaned in a blasting booth.

3. The method of claim 1 wherein the said portion of the pole is cleaned by blasting.

4. The method of claim 1 wherein the said profiled surface is at least 3.5 mil.

5. The method of claim 1 wherein the pole is placed in a drying oven for a predetermined length of time after the pole is removed from the flux tank.

6. The method of claim 1 wherein the pole is placed in the caustic tank for a minimum of approximately ten minutes.

7. The method of claim 1 wherein the pole is placed in the acid tank for a minimum of approximately ten minutes.

8. The method of claim 1 wherein the pole is placed into the flux tank for approximately two minutes.

9. The method of claim 5 wherein the pole is placed in the drying oven for a minimum of approximately twenty minutes.

10. The method of claim 1 wherein the pole is placed into the galvanizing kettle for approximately eight to ten minutes.

11. The method of claim 1 wherein the pole has a finished zinc thickness of approximately 6.0 mils in said portion.

12. The method of providing additional corrosion protection for a portion of a pole by increasing the thickness of a galvanizing layer, with the said portion being less than the entire pole, comprising the steps of:

cleaning the said portion of the pole which is less than the entire pole to create a profiled surface thereon thereby increasing the surface area of the said portion; and galvanizing the pole.

13. The method of claim 12 wherein the said portion of the pole is cleaned in a blasting booth.

14. The method of claim 12 wherein the said portion of the pole is cleaned by blasting.

15. The method of claim 12 wherein the said profiled surface is at least 3.5 mil.

* * * * *